US011705643B2

(12) United States Patent
Xi et al.

(10) Patent No.: US 11,705,643 B2
(45) Date of Patent: Jul. 18, 2023

(54) ANTENNA UNIT, ANTENNA APPARATUS AND ELECTRONIC DEVICE

(71) Applicants: Shanghai AVIC OPTO Electronics Co., Ltd., Shanghai (CN); Shanghai Tianma Micro-Electronics Co., Ltd., Shanghai (CN)

(72) Inventors: Kerui Xi, Shanghai (CN); Xuhui Peng, Shanghai (CN); Feng Qin, Shanghai (CN); Tingting Cui, Shanghai (CN); Zhenyu Jia, Shanghai (CN)

(73) Assignees: Shanghai AVIC OPTO Electronics Co., Ltd., Shanghai (CN); Shanghai Tianma Micro-Electronics Co., Ltd., Shanghai (CN)

( * ) Notice: Subject to any disclaimer, the term of this patent is extended or adjusted under 35 U.S.C. 154(b) by 56 days.

(21) Appl. No.: 17/530,425

(22) Filed: Nov. 18, 2021

(65) Prior Publication Data

US 2022/0077596 A1 Mar. 10, 2022

(30) Foreign Application Priority Data

Jun. 30, 2021 (CN) ..... 202110741875.7

(51) Int. Cl.

| | |
|---|---|
| ***H01Q 3/36*** | (2006.01) |
| ***H01Q 21/06*** | (2006.01) |
| ***H01Q 1/38*** | (2006.01) |
| ***H01Q 1/42*** | (2006.01) |

(52) U.S. Cl.

CPC ..... *H01Q 21/065* (2013.01); *H01Q 1/38* (2013.01); *H01Q 1/422* (2013.01); *H01Q 3/36* (2013.01)

(58) Field of Classification Search

CPC ..... H01Q 21/065; H01Q 1/38; H01Q 1/422; H01Q 3/36; H01Q 21/0075; H01Q 21/00

See application file for complete search history.

(56) References Cited

U.S. PATENT DOCUMENTS

2021/0135374 A1* 5/2021 Tsai ..... H01Q 1/44
2022/0352646 A1* 11/2022 Chiu ..... H01Q 21/065

FOREIGN PATENT DOCUMENTS

CN 209561604 U 10/2019
CN 109494456 B 11/2020

* cited by examiner

*Primary Examiner* — David E Lotter

(74) *Attorney, Agent, or Firm* — Kilpatrick Townsend & Stockton, LLP

(57) ABSTRACT

Disclosed antenna unit includes first substrate and second substrate opposite to each other, phase shifting units and driver circuit. Region facing the first substrate and the second substrate form phase shifting region. In first direction, the first substrate formed with first step region, and used for connecting radio-frequency signal terminal; in second direction, the second substrate formed with second step region, and included angle between the first direction and the second direction greater than or equal to 0° and smaller than 180°. At least part of the first step region does not overlap at least part of the second step region. Phase shifting units used for radiating radio-frequency signal and distributed in phase shifting region, each phase shifting unit. At least part of the driver circuit disposed in the second step region and the driver circuit electrically connected to each phase shifting unit to adjust radio-frequency signal.

20 Claims, 12 Drawing Sheets

ANTENNA UNIT, ANTENNA APPARATUS AND ELECTRONIC DEVICE

CROSS-REFERENCE TO RELATED APPLICATION(S)

This application claims priority to Chinese Patent Application No. 202110741875.7 filed Jun. 30, 2021, the disclosure of which is incorporated herein by reference in its entirety.

FIELD

The present application relates to the field of electromagnetic wave, and in particular, to an antenna unit, an antenna apparatus and an electronic device.

BACKGROUND

Antenna apparatuses can be used in a wide range of applications, such as communications between vehicles and satellites, array radars for unmanned vehicles or array radars for safety protection. A direction of a maximum value of an antenna pattern can be changed by controlling a phase, to achieve the purpose of beam scanning.

At present, due to the limitation of wiring and yield, it is difficult to achieve a multi-radiator deployment, which makes the antenna apparatus unable to achieve high gain.

SUMMARY

Embodiments of the present disclosure provide an antenna unit, an antenna apparatus and an electronic device, and the antenna unit can used in the antenna apparatus and improve the gain of the antenna apparatus.

In one embodiment, an antenna unit provided in embodiments of the present disclosure includes a first substrate and a second substrate disposed opposite to each other, a phase shifting units and a driver circuit. A region facing the first substrate and a region facing the second substrate together form a phase shifting region. In a first direction, the first substrate is formed with a first step region protruding from the phase shifting region, and the first step region is used for connecting a radio-frequency signal terminal; and in a second direction, the second substrate is formed with a second step region protruding from the phase shifting region, and an included angle between the first direction and the second direction is greater than or equal to 0° and smaller than 180°. In a direction perpendicular to a plane where the first substrate is located, at least part of the first step region does not overlap at least part of the second step region. The phase shifting units are distributed in an array and are located in the phase shifting region, and each phase shifting unit of the phase shifting units is used for radiating a radio-frequency signal. At least part of the driver circuit is disposed in the second step region and the driver circuit is electrically connected to each phase shifting unit to adjust the radio-frequency signal radiated by each phase shifting unit.

In another embodiment, an antenna apparatus provided in embodiments of the present disclosure includes antenna units described above. Phase shifting regions of the antenna units are sequentially spliced, where among each two antenna units of the antenna units having a spliced relationship, a phase shifting region of one antenna unit includes a first side edge facing away from a first step region and a second step region of the one antenna unit, a phase shifting region of the other antenna unit includes a second side edge facing away from a first step region and a second step region of the other antenna unit, and the first side edge and the side edge are butted with each other.

In yet another embodiment of the present disclosure provide an electronic device. The electronic device includes an antenna apparatus described above.

BRIEF DESCRIPTION OF DRAWINGS

Embodiments of the present disclosure will be described below with reference to the drawings.

100—antenna unit

Figure 1:
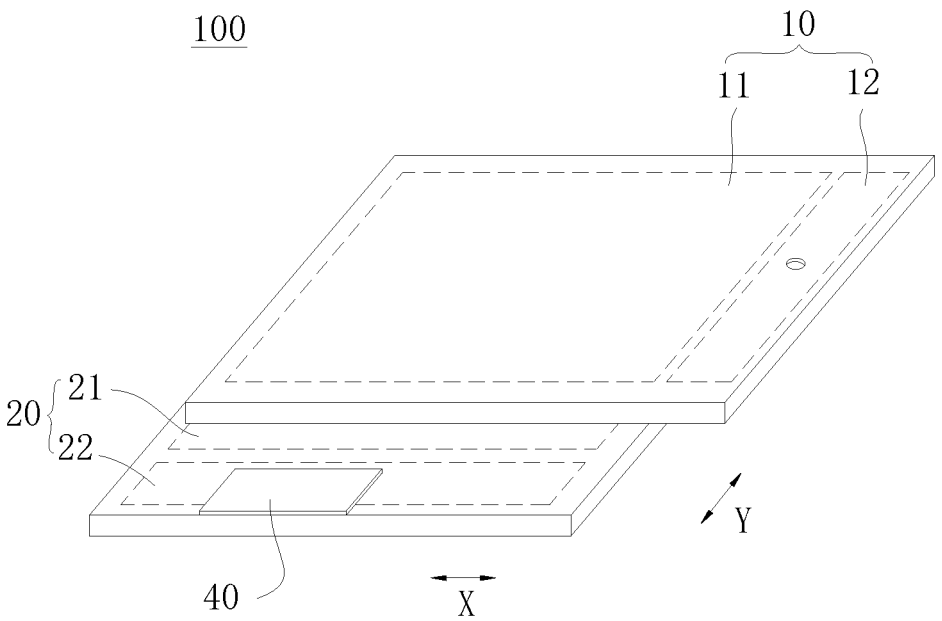
FIG. 1 is an axonometric view of an antenna unit according to an embodiment of the present disclosure.

10—first substrate; 11—first body region; 12—first step region; 13—first insulation layer; 14—first alignment layer;

20—second substrate; 21—second body region; 22—second step region; 23—second insulation layer; 24—second alignment layer;

20*a*—phase shifting layer; aa—first edge; bb—second edge; cc—third edge; dd—fourth edge; ee—fifth edge; ff—sixth edge; 20*b*—oblique angle;

30—phase shifting unit; 31—power feeder; 32—radiator; 33—grounding electrode; 34—drive electrode; 35—dielectric layer; 36—power feeder line; 37—control signal line;

40—driver circuit; 50—radio-frequency signal terminal

X—first direction; Y—second direction

In the drawings, same components use same reference numbers in the drawings. The drawings are not drawn to actual scale.

DETAILED DESCRIPTION

In order to better understand the solution of the present disclosure, embodiments of the present disclosure will be detailed below in conjunction with the drawings.

The embodiments described above are part, not all, of embodiments of the present disclosure. Based on the embodiments of the present disclosure.

Terms used in embodiments of the present disclosure are merely used to describe specific embodiments and not intended to limit the present disclosure. As used in the embodiments of the present disclosure and the appended claims, the singular forms, including "a", "an" and "the", are intended to include the plural forms as well, unless the context clearly indicates otherwise.

It should be understood that the term "and/or" in embodiments of the present disclosure merely describes the association relationships of associated objects and indicates that three relationships may exist. For example, A and/or B may indicate three conditions of A alone, both A and B, and B alone. In addition, the character "/" of the embodiments of the present disclosure generally indicates that the front and rear associated objects are in an "or" relationship.

It should be understood that although the terms first and second may be used in the embodiments of the present disclosure to describe the substrate, the phase shifting region, the insulation layer and the connection via, these substrates, the phase shifting region, the insulation layer and the connection via should not be limited to these terms, and these terms are merely used to distinguish the substrate, the phase shifting region, the insulation layer and the connection via from each other. For example, without departing from the scope of the embodiments of the present disclosure, a first substrate may be referred to as a second substrate. Similarly, a second substrate may be referred to as a first substrate.

As shown in FIGS. 1 to 4, an antenna unit 100 provided in the embodiment of the present disclosure includes a first substrate 10, a second substrate 20, a phase shifting units 30 and a driver circuit 40, where the first substrate 10 and the second substrate 20 are disposed opposite to each other, and a region facing the first substrate 10 and a region facing the second substrate 20 together form a phase shifting region 20*a*. In a first direction X, the first substrate 10 is formed with a first step region 12 protruding from the phase shifting region 20*a*, and the first step region 12 is used for connecting a radio-frequency signal terminal 50. In a second direction Y, the second substrate 20 is formed with a second step region 22 protruding from the phase shifting region 20*a*, and an included angle between the first direction X and the second direction Y is greater than or equal to 0° and smaller than 180°. In a direction perpendicular to a plane where the first substrate 10 is located, at least part of the first step region 12 and at least part of the second step region 22 do not overlap to each other. The phase shifting units 30 are distributed in an array and are located in the phase shifting region 20*a*, and each phase shifting unit 30 of the phase shifting units 30 is used for radiating a radio-frequency signal. At least part of the driver circuit 40 is disposed in the second step region 22 and electrically connected to each phase shifting unit 30 to adjust the radio-frequency signal radiated by each phase shifting unit 30.

In the antenna unit provided in the embodiment of the present disclosure, the phase shifting units 30 distributed in an array and located in the phase shifting region 20*a* can radiate radiation signals having different phases under the action of different control signals, to achieve the adjustment of a main lobe direction of the beam finally formed by the antenna and satisfy the performance requirements of the antenna unit.

At the same time, in the first direction X, the first substrate 10 is formed with the first step region 12 protruding from the phase shifting region 20*a*, and the first step region 12 is used for connecting the radio-frequency signal terminal 50. In the second direction Y, the second substrate 20 is formed with the second step region 22 protruding from the phase shifting region 20*a*, and the included angle between the first direction X and the second direction Y is greater than or equal to 0° and smaller than 180°. At least part of the driver circuit 40 is disposed in the second step region 22 and the driver circuit 40 is electrically connected to each phase shifting unit 30. In the direction perpendicular to the plane where the first substrate 10 is located, at least part of the first step region 12 and at least part of the second step region 22 do not overlap to each other. With the above arrangement of the antenna unit 100, electrical connection requirements between the radio-frequency signal terminal 50, the driver circuit 40 and the phase shifting units 30 can be satisfied. When an antenna apparatus having a high gain amount needs to be formed, antenna units 100 can be spliced with each other, so that the antenna apparatus is not limited by wiring and yield, and the high gain amount requirement of the antenna apparatus can be satisfied. When the antenna units 100 are spliced, compact splicing can be facilitated, and the number of spliced antenna units 100 can be increased, to improve the overall gain of the antenna apparatus.

In some embodiments, in the antenna unit 100 provided in the embodiment of the present disclosure, the first substrate 10 and the second substrate 20 each may be a rigid plate. In some embodiments, the first substrate 10 and the second substrate 20 each may be a flexible plate.

In some embodiments, the first substrate 10 and the second substrate 20 each may be a glass substrate, a Polyimide (PI) substrate or a Liquid Crystal Polymer (LCP) substrate. The region facing the first substrate 10 and the region facing the second substrate 20 together form the phase shifting region 20*a*, and the phase shifting units 30 are distributed in an array and are located in the phase shifting region 20*a*.

In an embodiment, the included angle between the first direction X and the second direction Y is any value in a range from 0° to 180°, including an end value 0°. That is, the first direction X in which the first step region 12 protrudes from the phase shifting region 20*a* and the second direction Yin which the second step region 22 protrudes from the phase shifting region 20*a* may be the same or may intersect.

In an embodiment, when the first direction X and the second direction Y intersect, the included angle between the first direction X and the second direction Y may be any value between a range from 30° to 120°, including 30° and 120°.

In some embodiments, the included angle between the first direction X and the second direction Y may be any value in a range from 45° to 90°, including 45° and 90°, such as 60°.

In order to better understand the antenna unit 100 provided in the embodiment of the present disclosure, the first direction X and the second direction Y intersect as an example for description below.

With continued reference to FIGS. 1 to 4, in an embodiment, in the antenna unit 100 provided in the embodiment of the present disclosure, the first substrate 10 may include a first body region 11 and the first step region 12 disposed successively along the first direction X, and the second substrate 20 may include a second body region 21 and the second step region 22 disposed successively along the second direction Y. The first body region 11 and the second body region 21 have a same shape and are opposite to each other to form the phase shift region 20*a*.

Figure 3:
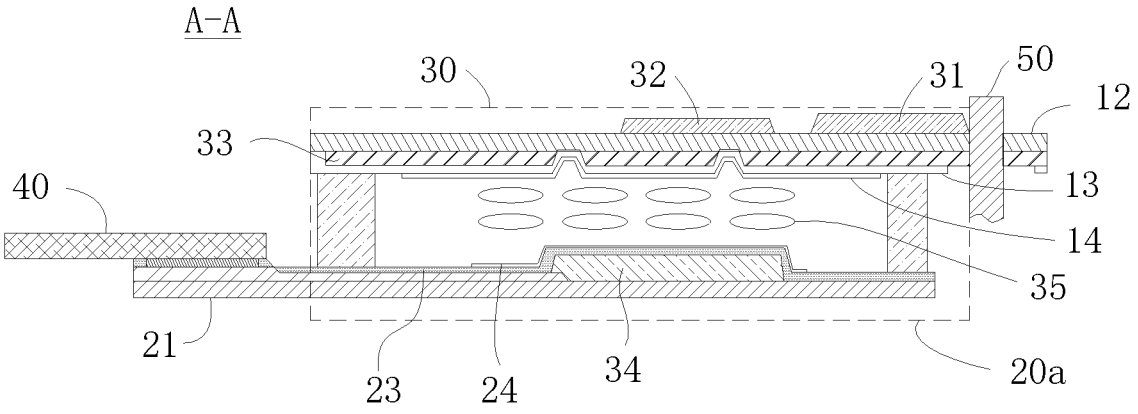
FIG. 3 is a sectional view taken along a direction A-A of FIG. 2.
Figure 4:
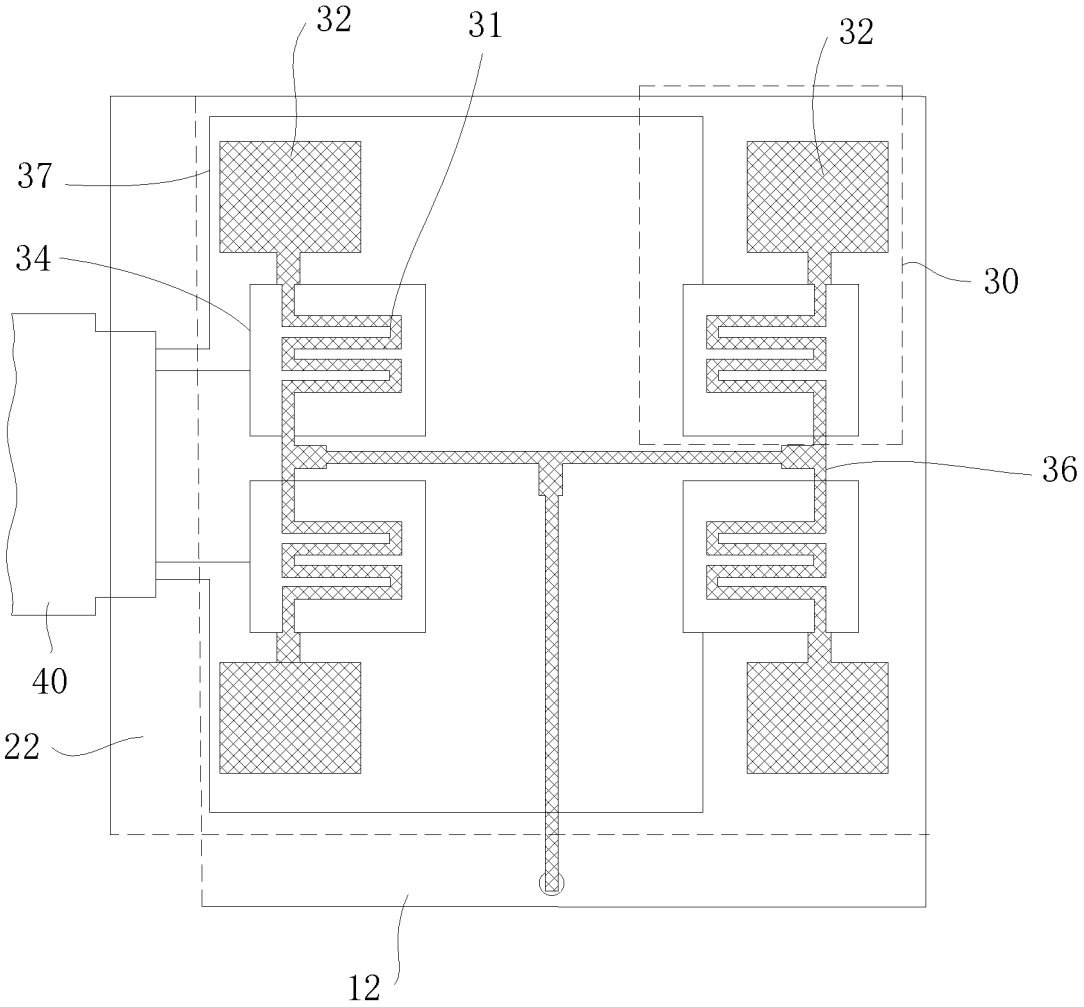
FIG. 4 is a top view of a cut antenna unit according to another embodiment of the present disclosure.

As shown in FIGS. 3 and 4, in some embodiments, each phase shifting unit 30 includes a power feeder 31, a radiator 32, a grounding electrode 33, a drive electrode 34 and a dielectric layer 35, where the power feeder 31 is electrically connected to a radio-frequency signal terminal 50, and the radiator 32 is coupled with the power feeder 31; and in a direction perpendicular to a plane where a first substrate 10 is located, the drive electrode 34 overlaps the power feeder 31 and the grounding electrode 33, and the dielectric layer 35 is disposed between the drive electrode 34 and the grounding electrode 33. In some embodiments, the dielectric layer 35 may use a Liquid Crystal Polymer (LCP) material or a photosensitive dielectric material. In order to better understand the antenna unit 100 provided in the embodiment of the present disclosure, the dielectric layer 35 may use a Liquid Crystal Polymer as an example for description.

Specifically, when the antenna unit 100 is controlled to send a beam, the radio-frequency signal is provided to the power feeder 31 in each phase shifting unit 30 through the radio-frequency signal terminal 50, a grounding signal is provided to the grounding electrode 33 in each phase shifting unit 30 through a grounding signal end, and the driver circuit 40 provides a control signal to the drive electrode 34 in each phase shifting unit 30. The Liquid Crystal Polymer in each phase shifting unit 30 is deflected by an electric field formed by the drive electrode 34 and the grounding electrode 33, so that the dielectric constant of the liquid crystal polymer is changed, and the radio-frequency signal transmitted in the power feeder 31 is phase-shifted. The phase-shifted radio frequency signal is radiated through the radiator 32 in the phase shifting unit 30, and a radio-frequency signals radiated by the phase shifting units 30 interfere to form a beam having a main lobe direction, to satisfy the performance requirements of the antenna unit 100.

For one phase shifting unit 30, the driver circuit 40 provides different control signals to the drive electrode 34, and the electric field form by the drive electrode 34 and the grounding electrode 33 drives the liquid crystal polymer to deflect, so that the liquid crystal polymer may have different dielectric constants, and then the phase shifting unit 30 performs shifting the phase for the radio-frequency signal to different extents, that is, in the embodiment of the present disclosure, the phase shifting unit 30 is a phase shifting unit whose control signal voltage is variable, and one phase shifting unit 30 can radiate radio-frequency signals having a phases. Thus, by adjusting the phase of the radio-frequency signals radiated by the phase shifting unit 30, when the radio-frequency signals radiated by the phase shifting units 30 interfere with each other, the direction of the main lobe of the final formed beam can be adjusted.

The radiator 32 in the phase shifting unit 30 can radiate and receive signals. When the radiator 32 receives the radio-frequency signal, the liquid crystal polymer in the phase shifting unit 30 controls the phase shifting of the radio-frequency signal, and the phase shifted radio-frequency signal is transmitted to the radio-frequency signal terminal 50 via the power feeder 31, and outputted via the radio-frequency signal terminal 50.

As shown in FIGS. 3 and 4, as an embodiment, in each antenna unit 100, the grounding electrode 33 is disposed in a layer different from a layer where the drive electrode 34 and the power feeder 31 are disposed, the power feeder 31 and the radiator 32 are disposed on a surface of a first substrate 10 facing away from a second substrate 20, the grounding electrode 33 is disposed on a surface of the first substrate 10 facing the second substrate 20, and a first insulation layer 13 and a first alignment layer 14 are disposed on the surface of the ground electrode 33 facing the second substrate 20 to protect the ground electrode 33 and play an alignment action for liquid crystal molecules. The drive electrode 34 is disposed on a surface of the second substrate 20 facing the first substrate 10, and a second insulation layer 23 and a second alignment layer 24 are disposed on the surface of the drive electrode 34 facing the first substrate 10 to protect the drive electrode 34 and play an alignment action for liquid crystal molecules.

It can be understood that this is an embodiment, but limitations would not be made thereto. In some embodiments, the grounding electrode 33 and the power feeder 31 may be disposed in a same layer, the radiator 32, the power feeder 31 and the grounding electrode 33 are all disposed on a surface of a first substrate 10 facing a second substrate 20, and the drive electrode 34 is disposed on a surface of the second substrate 20 facing the first substrate 10. The performance requirement of the antenna unit 100 can also be satisfied. At the same time, the power feeder 31, the radiator 32 and the grounding electrode 33 are all disposed on a surface of the first substrate 10 facing the second substrate 20, so that in the process flow of forming the power feeder 31, the radiator 32 and the grounding electrode 33, merely one layer of metal, such as one layer of copper, is evaporated on the surface of the first substrate 10, and then the power feeder 31, the radiator 32 and the grounding electrode 33 can be etched by using one mask process, thus simplifying the process flow and reducing the manufacturing cost.

In some embodiments, the antenna unit 100 and the antenna apparatus provided in the embodiment of the present disclosure further include a power feeder line 36, a first substrate 10 of each antenna unit 100 is provided with the power feeder line 36, and power feeders 31 of a phase shifting units 30 of a same antenna unit 100 are electrically connected to a same radio-frequency signal terminal 50 through the power feeder line 36. Thus, the radio frequency signal supplied from the radio frequency signal end 50 is transmitted to the power feeder 31 of each phase shifting unit 30 via the power feeder line 36, to ensure the normal operation of each phase shifting unit 30. Moreover, with this arrangement, merely one radio-frequency signal terminal 50 is provided in the antenna unit 100 to transmit radio-frequency signals to the power feeder 31 of each phase shifting unit 30, to reduce the number of radio-frequency signal terminals 50 required to be provided and further reducing the manufacturing cost of the antenna unit 100.

As an embodiment, the antenna unit 100 provided in the embodiment of the present disclosure further include a control signal lines 37, the control signal lines 37 are disposed on the second substrate 20, and the drive electrode 34 of each phase shifting unit 30 of the same antenna unit 100 is connected to the driver circuit 40 of the same antenna unit 100 through one control signal line 37. Based on this arrangement, the control signals received by the phase shifting units 30 are independent of each other. By controlling the phase shifting of the radio-frequency signal by each phase shifting unit 30, the accuracy of adjusting the main lobe direction of the beam formed by the antenna unit 100 can be improved.

In some embodiments, a driver circuit 40 of each antenna unit 100 includes a flexible circuit board, the flexible circuit board includes a control signal terminals, and the control signal terminals are electrically connected to the control signal lines 37 in one-to-one correspondence. In one embodiment, a transmission path of the control signal is formed between the control signal line 37, the drive electrode 34 and the control signal end of the flexible circuit board to ensure that the control signal is transmitted to the drive electrode 34, to ensure that an electric field is formed between the drive electrode 34 and the grounding electrode 33 to drive the liquid crystal polymer to deflect and shift the phase of the radio frequency signal.

As an embodiment, in the antenna unit 100 provided in the embodiment of the present disclosure, an orthographic projection of the phase shifting region 20*a* on the plane where the first substrate 10 is located is in a shape of a polygon, an orthographic projection of the first step region 12 on the plane where the first substrate 10 is located starts from one edge of the polygon and protrudes along the first direction X and away from the polygon, and an orthographic projection of the second step region 22 on the plane where the first substrate 10 is located starts from another edge of the polygon and protrudes along the second direction Y and away from the polygon. In other words, a shape of an orthographic projection of the first body region 11 on the plane where the first substrate 10 is located and a shape of an orthographic projection of the second body region 21 on the plane where the first substrate 10 is located are same and polygonal. A direction in which the first step region 12 protrudes from the phase shifting region 20*a* is different from a direction in which the second step region 22 protrudes from the phase shifting region 20*a* and the included angle between the two directions is smaller than 180°.

With the above arrangement, the connection and control requirements between the driver circuit 40, the radio-frequency signal terminals 50 and the phase shifting units 30 can be achieved. With the above arrangement, the first step region 12 of the antenna unit 100 and the second step region 22 of the antenna unit 100 may be provided on adjacent sides, so that when the antennas are spliced, regions where edges of the phase shifting regions 20*a* in which the first step region 12 and the second step region 22 are not provided are located can be spliced with each other. This arrangement enables the antenna units 100 to be spliced in a directions, to increase the number of antenna units 100 included in the antenna apparatus under the condition of the same length size and/or width size, achieve a multi-radiator 32 arrangement and improve the gain of the antenna apparatus.

In some embodiments, in the antenna unit 100 provided in the embodiment of the present disclosure, each edge of the polygon presented by the orthographic projection of the phase shifting region 20*a* on the plane where the first substrate 10 is located is equal in length. The above arrangement facilitates the connection and control among the radio-frequency signal terminal 50, the driver circuit 40 and each phase shifting unit 30. At the same time, since each edge of the polygon presented by the orthographic projection of the phase shifting region 20*a* on the plane where the first substrate 10 is located is equal in length, the phase shifting regions 20*a* of the antenna units 100 are facilitated to be spliced with each other when the antenna units 100 are spliced to form the antenna device.

As an embodiment, when each edge of the polygon presented by the orthographic projection of the phase shifting region 20*a* on the plane where the first substrate 10 is located is equal in length, the polygon may be made to be a rhombus or a regular polygon to satisfy the splicing requirement between the antenna units 100.

As an example, the orthographic projection of the phase shifting region 20*a* on the plane where the first substrate 10 is located is in a shape of the regular polygon, the regular polygon includes n edges, and n is greater than or equal to 3. In other words, an orthographic projection of the first body region 11 of the first substrate 10 on the plane where the first substrate 10 is located and an orthographic projection of the second body region 21 of the second substrate 20 on the plane where the first substrate 10 is located are in shapes of regular polygons, such as regular triangles, regular quadrangles, regular pentagons or the like.

In order to better understand a display panel provided in the embodiment of the present disclosure, an example will be described in which n edges of the orthographic projection of the phase shifting region 20*a* on the plane where the first substrate 10 is located are 4 edges.

As shown in FIGS. 1 to 4, when n=4, the orthographic projection of the phase shifting region 20*a* on the plane where the first substrate 10 is located is in a shape of a quadrangle, such as a regular quadrangle. In other words, the first body region 11 included in the first substrate 10 on the plane where the first substrate 10 is located and the second body region 21 included in the second substrate 20 on the plane where the first substrate 10 is located are in shapes of the regular quadrangles.

The orthographic projection of the phase shifting region 20*a* on the plane where the first substrate 10 is located may include a first edge aa, a second edge bb, a third edge cc, and a fourth edge dd, which are equal in lengths. The first edge aa, the second edge bb, the third edge cc, and the fourth edge dd are arranged in succession, two adjacent edges are connected and perpendicular to each other, and the first edge aa, the second edge bb, the third edge cc, and the fourth edge dd together form a regular quadrangle.

The orthographic projection of the first step region 12 on the plane where the first substrate 10 is located starts from the first edge aa of the regular quadrangle and protrudes along the first direction X and away from the regular quadrangle, and the orthographic projection of the second step region 22 on the plane where the first substrate 10 is located starts from the second edge bb of the regular quadrangle and protrudes along the second direction Y and away from the regular quadrangle. The shape of the orthographic projection of the first step region 12 on the plane where the first substrate 10 is located and the shape of the orthographic projection of the second step region 22 on the plane where the first substrate 10 is located are rectangles. With the above arrangement, four antenna units 100 may be arranged in two rows and two columns by splicing four antenna units 100 with each other. Among two antenna units 100 spliced with each other, a region where a third edge cc of one antenna unit 100 is located and a region where a fourth edge dd of the other antenna unit 100 is located can be butted with each other to ensure the butting between the antenna units 100 and improve the gain of the formed antenna apparatus.

Figure 5:
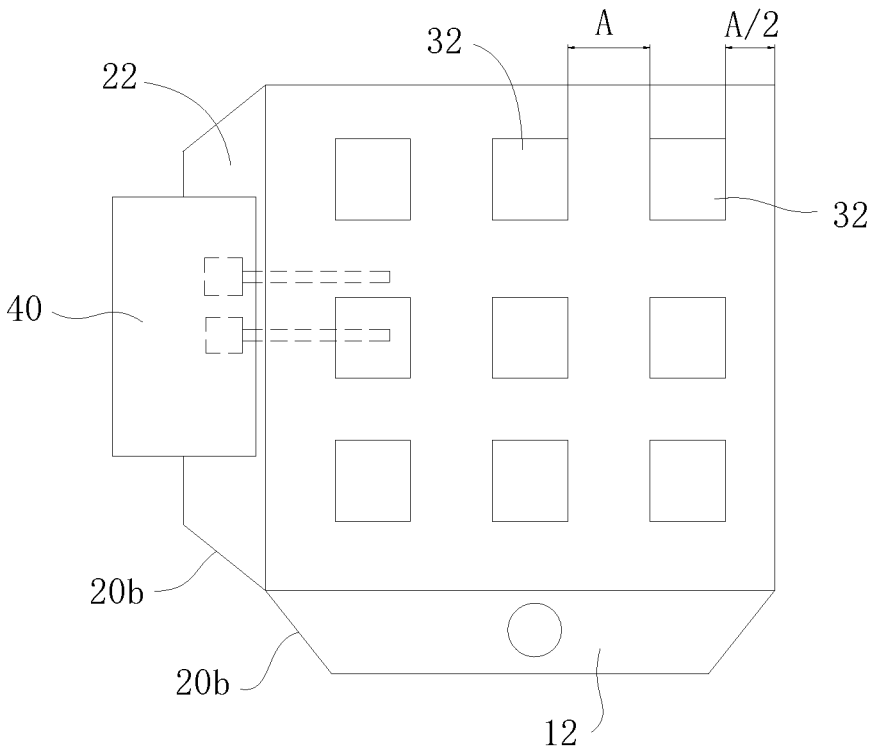
FIG. 5 is a top view of an antenna unit according to another embodiment of the present disclosure.

As shown in FIG. 5, as an embodiment, in the antenna units 100 provided in the embodiment of the present disclosure, a minimum distance A is provided between two adjacent radiators 32 of each antenna unit 100. In an orthographic projection of the plane where the first substrate 10 is located, a distance between a radiator 32 disposed on an edge of the orthographic projection close to the phase shifting region 20*a* and the edge is A/2. With the above arrangement, when the antenna units 100 are spliced to form the antenna apparatus, a distance between each two adjacent radiators 32 is equal, so that the performance of the formed antenna apparatus is optimized, the symmetry of the antenna apparatus is ensured, and the gain and accuracy of the antenna apparatus are improved.

As an embodiment, in the antenna unit 100 of the embodiment of the present disclosure, at least one end of the first step region 12 along an extending direction of an edge where the first step region 12 is located is provided with an oblique angle 20*b*. With the above arrangement, stress concentration at a connection position between the first step region 12 and the first body region 11 of the first substrate 10 can be reduced, and the safety performance of the antenna unit 100 can be improved. In an embodiment, at least one end of the second step region 22 along an extending direction of an edge where the second step region 22 is located is provided with an oblique angle 20*b*. With the above arrangement, stress concentration at a connection position between the second step region 22 and the second body region 21 of the second substrate 20 can be reduced, and the safety performance of the antenna unit 100 can be further improved.

It can be understood that in the antenna unit provided in each embodiment of the present disclosure, an example will be described in which n edges of the orthographic projection of the phase shifting region 20*a* on the plane where the first substrate 10 is located is 4 edges and the orthographic projection of the phase shifting region 20*a* on the plane where the first substrate 10 is located is in the shape of the regular quadrangle.

Figure 6:
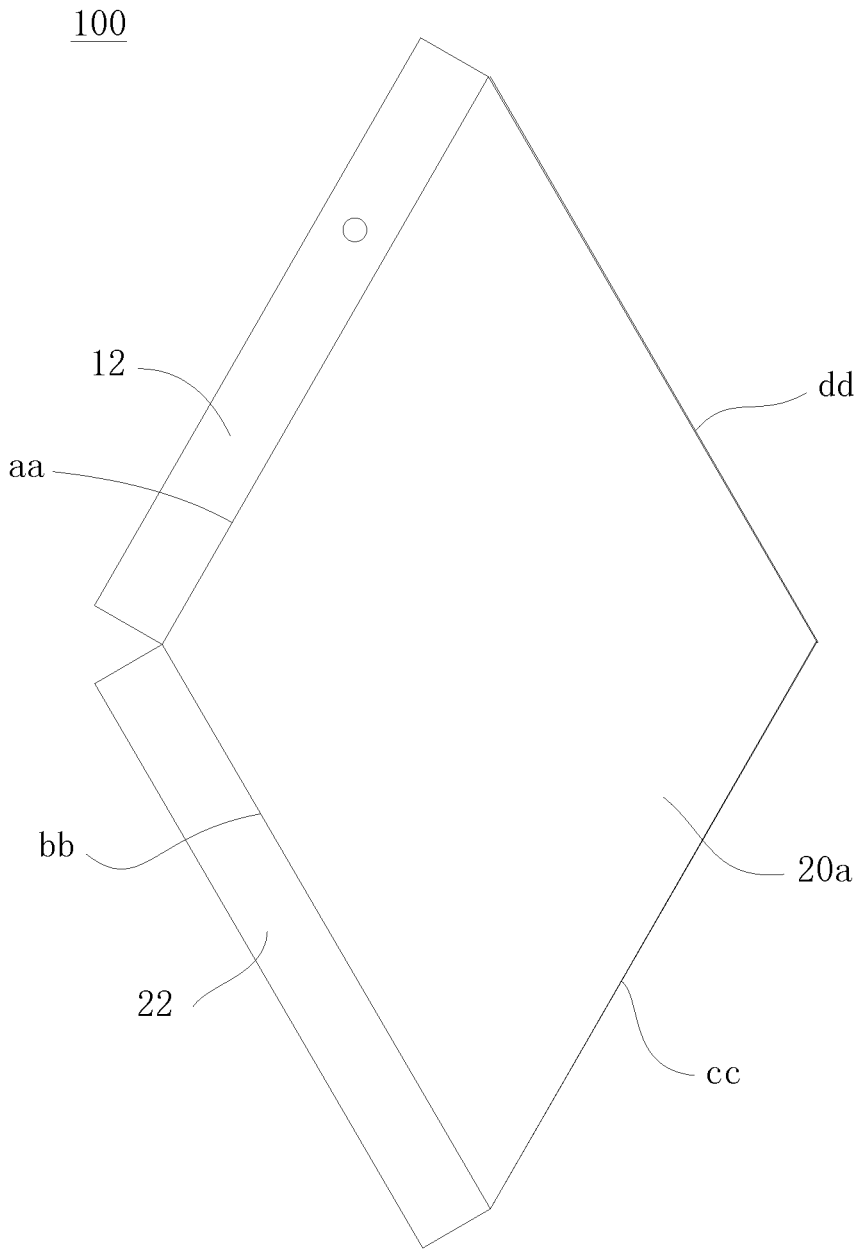
FIG. 6 is a top view of an antenna unit according to another embodiment of the present disclosure.

As shown in FIG. 6, in some other embodiments, the n edges of the orthographic projection of the phase shifting region 20*a* of the antenna unit 100 on the plane where the first substrate 10 is located is 4 edges. In this case, a shape of the orthographic projection of the phase shifting region 20*a* on the plane where the first substrate 10 is located may be the rectangle and the rhombus. When the shape of the orthographic projection is the rhombus, the orthographic projection of the phase shifting region 20*a* on the plane where the first substrate 10 is located may also include a first edge aa, a second edge bb, a third edge cc, and a fourth edge dd, which are equal in lengths. The first edge aa, the second edge bb, the third edge cc, and the fourth edge dd are arranged in succession, two adjacent edges are connected and intersect, an included angle between the two adjacent edges is 60° or 120°, and the first edge aa, the second edge bb, the third edge cc, and the fourth edge dd together form the rhombus. The orthographic projection of the first step region 12 on the plane where the first substrate 10 is located starts from the first edge aa of the rhombus presented by the phase shifting region 20*a* and protrudes along the first direction X and away from the rhombus, and the orthographic projection of the second step region 22 on the plane where the first substrate 10 is located starts from the second edge bb of the rhombus and protrudes along the second direction Y and away from the rhombus. The shape of the orthographic projection of the first step region 12 on the plane where the first substrate 10 is located and the shape of the orthographic projection of the second step region 22 on the plane where the first substrate 10 is located are rectangles. With the above arrangement, three antenna units 100 may be spliced with each other. When the three antenna units 100 are spliced, the three antenna units 100 can be arranged in succession in a ring direction around a same axis and spliced successively. Among two antenna units 100 spliced with each other, a region where a third edge cc of one antenna unit 100 is located and a region where a fourth edge dd of the other antenna unit 100 is located can be butted with each other to ensure the gain of the antenna apparatus formed by butting the antenna units 100.

It can be understood that in the antenna unit provided in each embodiment of the present disclosure, an example will be described in which n edges of the orthographic projection of the phase shifting region 20*a* on the plane where the first substrate 10 is 4 edges.

Figure 7:
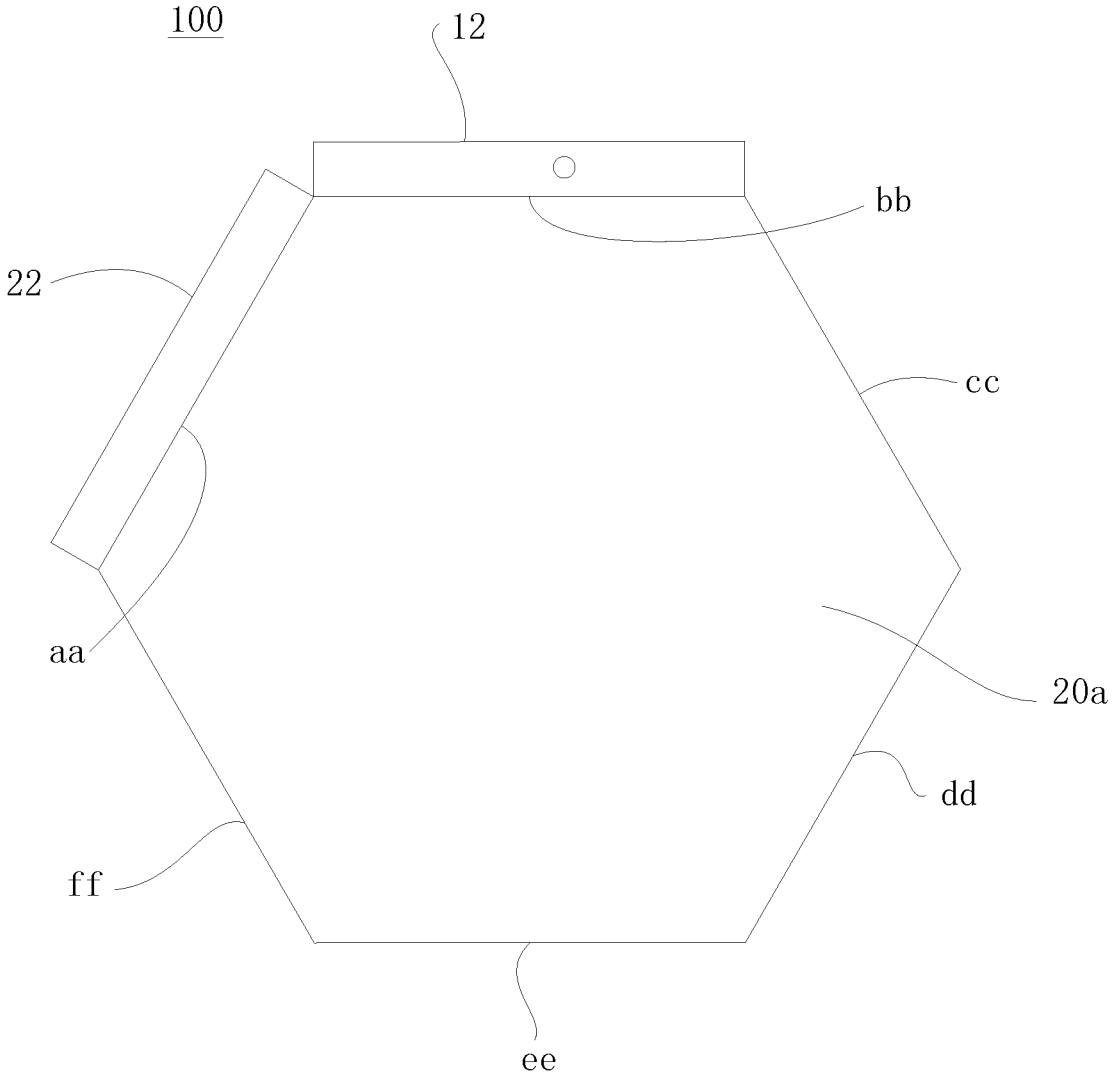
FIG. 7 is a top view of an antenna unit according to another embodiment of the present disclosure.

As shown in FIG. 7, in some other embodiments, an example will be described in which n edges of the orthographic projection of the phase shifting region 20*a* on the plane where the first substrate 10 is located may be 6 edges. In this case, a shape of the orthographic projection of the phase shifting region 20*a* on the plane where the first substrate 10 is located may be the regular hexagon. The orthographic projection of the phase shifting region 20*a* on the plane where the first substrate 10 is located may include a first edge aa, a second edge bb, a third edge cc, a fourth edge dd, a fifth edge ee and a sixth edge ff, which are equal in lengths, and the first edge aa, the second edge bb, the third edge cc, the fourth edge dd, the fifth edge ee and the sixth edge ff are arranged in succession. Two adjacent edges are connected and intersect, and an included angle between the two adjacent edges is 120°. The orthographic projection of the first step region 12 on the plane where the first substrate 10 is located starts from the first edge aa of the regular hexagon and protrudes along the first direction X and away from the regular hexagon, and the orthographic projection of the second step region 22 on the plane where the first substrate 10 is located starts from the second edge bb of the regular hexagon and protrudes along the second direction Y and away from the regular hexagon. The shape of the orthographic projection of the first step region 12 on the plane where the first substrate 10 is located and the shape of the orthographic projection of the second step region 22 on the plane where the first substrate 10 is located are the rectangles. With the above arrangement, six antenna units 100 may be spliced with each other. When the six antenna units 100 are spliced, the six antenna units 100 can be arranged in succession in a ring direction around a same axis and spliced successively. In two antenna units 100 spliced with each other, the antenna unit 100 may be butted with the other antenna unit 100 by one of the third edge cc, the fourth edge dd, the fifth edge ee, and the sixth edge ff in which the first step region 12 and the second step region 22 are not provided, to improve the gain of the formed antenna apparatus.

The n edges of the orthographic projection of the phase shifting region 20*a* on the plane where the first substrate 10 is located is 4 edges or 6 edges, which is illustrated merely for better understanding of the antenna unit 100 provided by the embodiment of the present disclosure, and is not limited to the above values, but can be specifically adjusted according to requirements, for example, in some examples, n may be equal to 5, 7, 8, 9, 10, etc. The gain requirement of the antenna unit 100 can be ensured as long as the splicing requirement of the antenna unit 100 can be satisfy when the antenna unit 100 is used in the antenna apparatus.

It can be understood that each embodiment described above are all illustrated as an example that the first direction X and the second direction Y intersect, but is not limited to the manner. In some embodiments, the first direction X and the second direction Y can be the same, that is, the included angle between the first direction X and the second direction Y is 0°. It is also possible to satisfy the splicing between the antenna units 100 and improve the gain of the formed antenna apparatus.

As an embodiment, the orthographic projection of the phase shifting region 20*a* on the plane where the first substrate 10 is located is in the shape of the polygon, the orthographic projection of the first step region 12 on the plane where the first substrate 10 is located and the orthographic projection of the second step region 22 on the plane where the first substrate 10 is located start from a same edge of the polygon and protrude away from the polygon.

Figure 8:
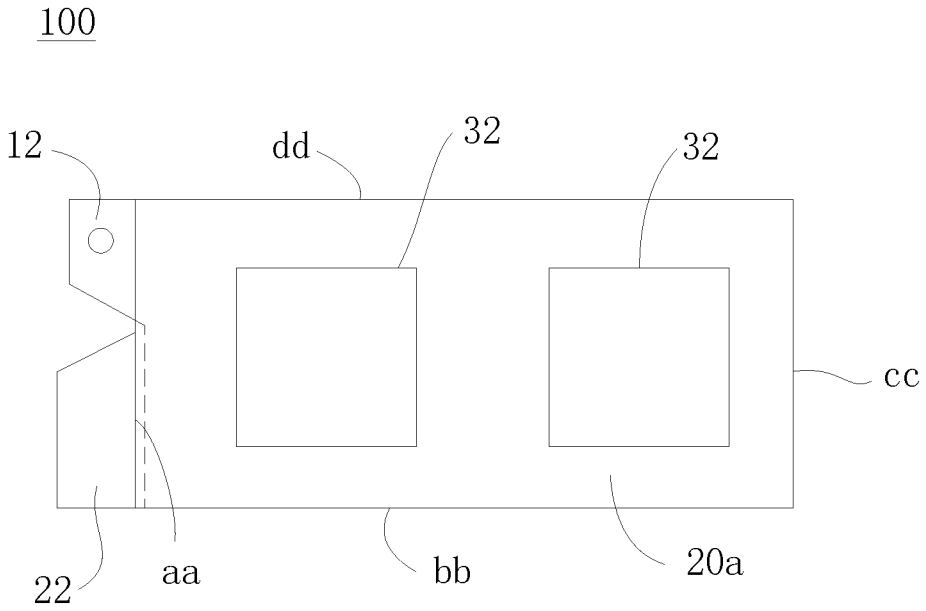
FIG. 8 is a top view of an antenna unit according to another embodiment of the present disclosure.

As shown in FIG. 8, exemplarily, in order to better understand the antenna unit 100 provided in the embodiment of the present disclosure, the orthographic projection of the phase shifting region 20*a* on the plane where the first substrate 10 is located is in the shape of the quadrangle as an example. The shape of the orthographic projection of the phase shifting region 20*a* on the plane where the first substrate 10 is located may be the rectangle and include a first edge aa, a second edge bb, a third edge cc, and a fourth edge dd, which are arranged in succession and connected successively, two adjacent edges are connected, an included angle between the two adjacent edges is 90°, and the first edge aa, the second edge bb, the third edge cc, and the fourth edge dd together form the rectangle. The orthographic projection of the first step region 12 on the plane where the first substrate 10 is located starts from the first edge aa of the rectangle and protrudes along the first direction X and away from the rectangle, and the orthographic projection of the second step region 22 on the plane where the first substrate 10 is located starts from the first edge aa of the rectangle and protrudes along the second direction Y and away from the rectangle. The orthographic projection of the first step region 12 on the plane where the first substrate 10 is located and the orthographic projection of the second step region 22 on the plane where the first substrate 10 is located at least partially stagger or do not overlap, to satisfy the connection between the driver circuit 40 and the radio-frequency signal lines.

Figure 9:
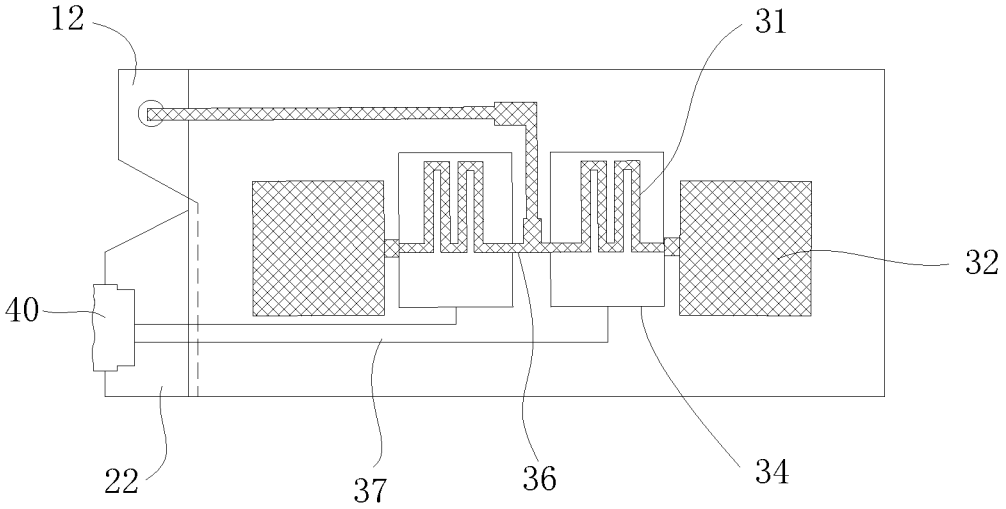
FIG. 9 is a top view of a cut antenna unit according to another embodiment of the present disclosure.

As shown in FIG. 9, when the orthographic projection of the first step region 12 on the plane where the first substrate 10 is located and the orthographic projection of the second step region 22 on the plane where the first substrate 10 is located start from the first edge aa of the rectangle presented by the phase shifting region 20*a* and protrude away from the quadrangle, the radio-frequency signal terminal and the driver circuit 40 are located at a side where the same edge of the orthographic projection of the phase shifting region 20*a* is located. At the same time, the power feeder lines 36 may be provided on the first substrate 10, and the feeder portions 31 of the phase shifting units 30 of the same antenna unit 100 are electrically connected to the same radio-frequency signal terminal through the power feeder lines 36. The control signal lines 37 may be provided on the second substrate 20, and the drive electrode 34 of each phase shifting unit 30 of the same antenna unit 100 is electrically connected to the driver circuit 40 through one control signal line 37.

It can be understood that when the shape of the orthographic projection of the phase shifting region 20*a* is a quadrangle, the quadrangle may be a rectangle, a square or the rhombus.

It can be understood that when the orthographic projection of the first step region 12 on the plane where the first substrate 10 is located and the orthographic projection of the second step region 22 on the plane where the first substrate 10 is located start from a same edge of the polygon and protrude away from the polygon, the shape of the orthographic projection of the phase shifting region 20*a* on the plane where the first substrate 10 is located is not limited to the quadrangle.

Figure 10:
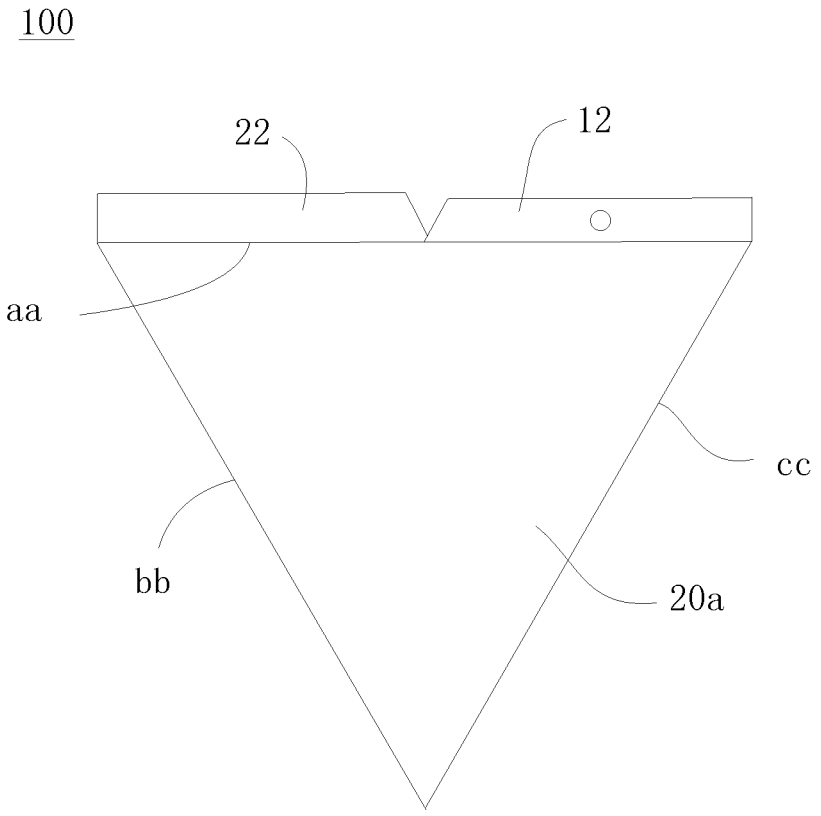
FIG. 10 is a top view of an antenna unit according to another embodiment of the present disclosure.

As shown in FIG. 10, the shape of the orthographic projection of the phase shifting region 20 on the plane where the first substrate 10 is located may also use the triangle, that is, the n edges of the orthographic projection of the phase shifting region 20*a* of the antenna unit 100 on the plane where the first substrate 10 is located is 3 edges, and the orthographic projection of the phase shifting region 20*a* of the antenna unit 100 on the plane where the first substrate 10 is located includes a first edge aa, a second edge bb and a third edge cc, which are arranged in succession and connected successively. An included angle between two adjacent edges is 60°, the first edge aa, the second edge bb and the third edge cc together form the triangle. The orthographic projection of the first step region 12 on the plane where the first substrate 10 is located starts from the first edge aa of the triangle and protrudes away from the triangle, and the orthographic projection of the second step region 22 on the plane where the first substrate 10 is located starts from the first edge aa of the triangle and protrudes away from the triangle. The orthographic projection of the first step region 12 on the plane where the first substrate 10 is located and the orthographic projection of the second step region 22 on the plane where the first substrate 10 is located at least partially stagger or do not overlap, to satisfy the connection between the driver circuit 40 and the radio-frequency signal lines.

It should be noted that when the orthographic projection of the first step region 12 on the plane where the first substrate 10 is located and the orthographic projection of the second step region 22 on the plane where the first substrate 10 is located start from a same edge of the polygon and protrude away from the polygon, the shape of the orthographic projection of the phase shifting region 20*a* on the plane where the first substrate 10 is located is not limited to the triangle or the quadrangle. In other examples, the pentagon and the hexagon may also be used, and which is not specifically limited in the present application.

Figure 11:
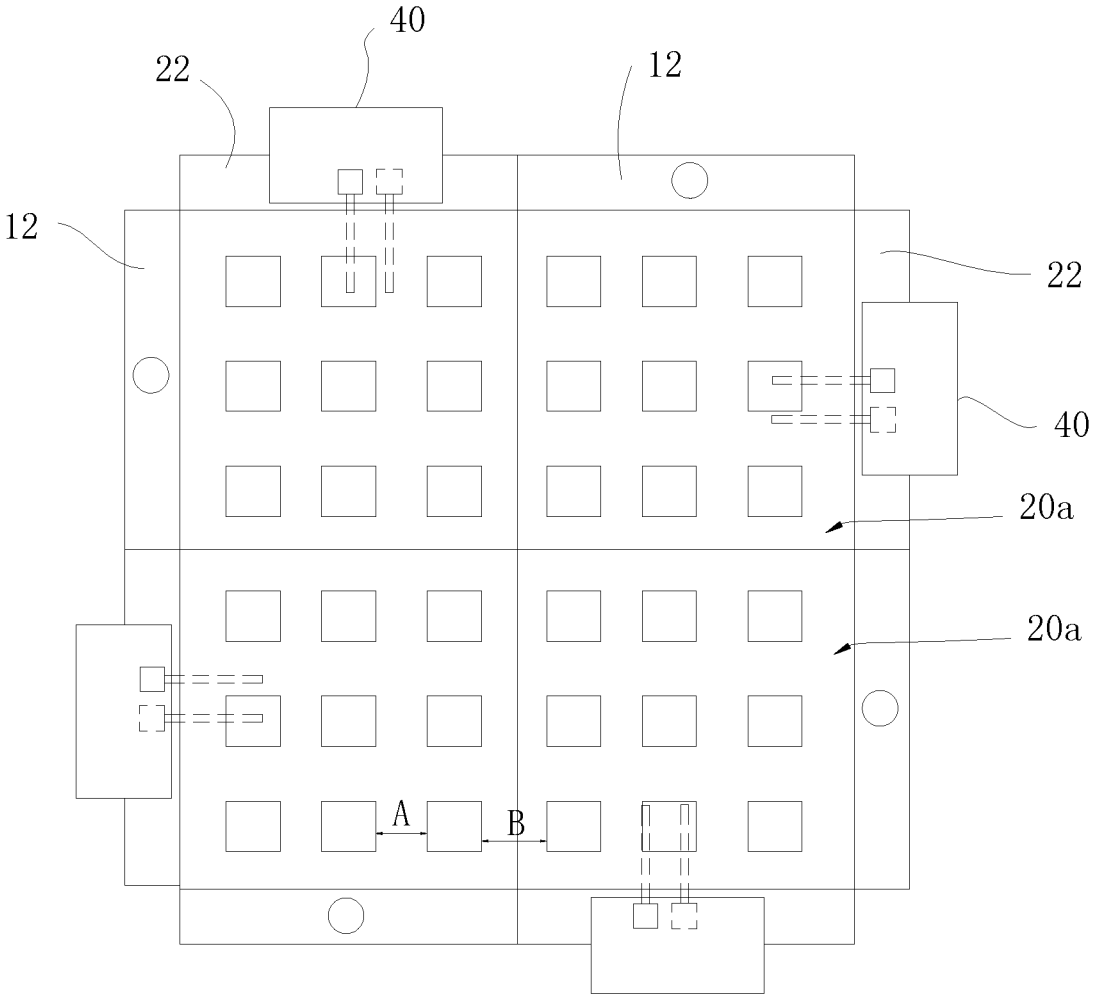
FIG. 11 is a structural diagram of an antenna apparatus according to an embodiment of the present disclosure.

As shown in FIG. 11, on the other hand, an antenna apparatus is further provided in embodiment of the present disclosure and includes antenna units 100 described above. Phase shifting regions 20*a* of each of the antenna units 100 are sequentially spliced. Among each two antenna units 100 having a spliced relationship, a phase shifting region 20*a* of one antenna unit 100 includes a first side edge facing away from a first step region 12 and a second step region 22 of the one antenna unit 100, a phase shifting region 20*a* of the other antenna unit 100 includes a second side edge facing away from a first step region 12 and a second step region 22 of the other antenna unit 100, and the first side edge and the second side edge are butted with each other.

Since the antenna apparatus provided in the embodiment of the present disclosure uses the antenna units 100 provided in the embodiments described above, the arrangement of the first step region 12 and the second step region 12 is beneficial to the driver circuit and a connection and control requirements between the radio-frequency signal terminal 50 and the phase shifting unit 30. The antenna apparatus is spliced by using the antenna units 100, which can implement a multi-radiation arrangement by using a phase shifting units 30 in phase shifting regions of the antenna unit, so that the antenna apparatus as a whole can satisfy the high gain requirement. At the same time, a distance between a radiator 32 of one antenna unit 100 of two antenna units 100 spliced with each other and a radiator 32 of the other antenna unit 100 of the two antenna units adjacent to the one antenna unit 100 can be reduced by using the antenna units 100 provided by the above embodiments, to improve the gain of the antenna apparatus as a whole.

In some other embodiments, m antenna units 100 are provided in the embodiment of the present disclosure, and m≥2. The m antenna units 100 are distributed in rows and columns, each row includes two antenna units 100. A value of m may be 2, 3, 4, 5, or even more, and may be specifically set according to the shape of the antenna unit 100 and the gain requirement of the antenna apparatus to be spliced.

As an embodiment, in the antenna apparatus provided in the embodiment of the present disclosure, an orthographic projection of each phase shifting region 20*a* of the antenna unit 100 on a plane where a first substrate 10 is located is in a shape of a polygon. For example, in the antenna apparatus provided in the embodiment of the present disclosure, the orthographic projection of the phase shifting region 20*a* on the plane where the first substrate 10 is located is in a shape of a rectangle or a square, to facilitate the splicing of the antenna units 100 and ensuring that the phase shifting regions 20*a* of the antenna units 100 can be spliced to form a flat surface. The gain of the antenna unit 100 is improved.

As an embodiment, in the antenna units 100 provided in the embodiment of the present disclosure, a minimum distance A is provided between two adjacent radiators 32 of each antenna unit 100. Among two antenna units 100 spliced with each other, a minimum distance B is provided between a radiator 32 of one antenna unit 100 and a radiator 32 of the other antenna unit 100 adjacent to the radiator of the one antenna unit 100, and A=B. With the above arrangement, when the antenna units 100 are spliced, the radiators 32 are uniformly distributed, to optimize the performance of the formed antenna apparatus and ensuring the gain requirement of the antenna apparatus.

In order to better understand the antenna apparatus provided in the embodiment of the present disclosure, the antenna apparatus provided by the embodiment of the present disclosure is described by taking the number of antenna units 100 as four, the four antenna units 100 distributed in rows and columns matrix, each row including two antenna units 100, and each column including two antenna units 100 as an example.

Figure 2:
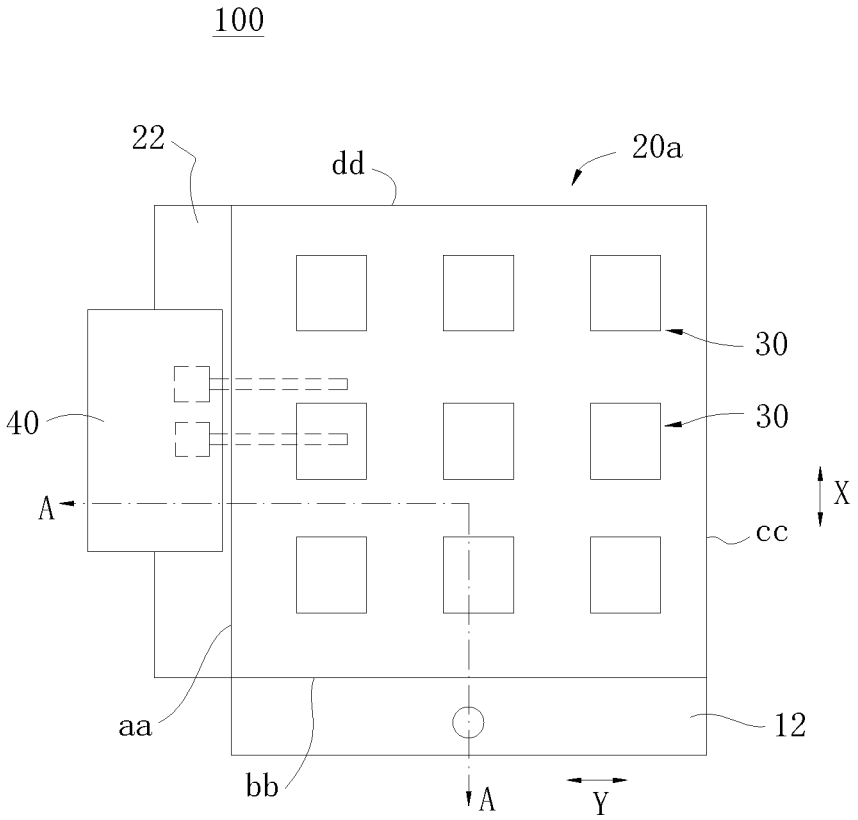
FIG. 2 is a top view of an antenna unit according to an embodiment of the present disclosure.

As shown in FIG. 11, exemplarily, taking an antenna apparatus provided by the embodiment of the present disclosure including four antenna apparatuses shown in FIG. 2 as an example, the four antenna apparatuses are distributed in rows and columns. The shape of an orthographic projection of the phase shifting region 20*a* of the antenna unit 100 on the plane where the first substrate 10 is located is a square, and a direction of which the first step region 12 protrudes from the phase shifting region 20*a* is perpendicular to a direction of which the second step region 22 protrudes form the phase shifting region 20*a*, that is, in this example, the first direction X is perpendicular to the second direction Y, and the first step region 12 and the second step region 22 may be disposed on different edges of the phase shifting region 20*a*. When the antenna units 100 are spliced, the phase shifting region 20*a* of each of the antenna units 100 are sequentially spliced to form an entire splicing surface, and each first step region 12 and each second step region 22 are alternately disposed on a periphery the entire splicing surface formed by splicing the phase shifting regions 20*a*, that is, in the orthographic projection of the antenna apparatus on the plane where the first substrate 10 is located, the first step region 12 of one of two adjacent antenna units 100 is separated from the first step region 12 of the other one of two adjacent antenna units 100 by a second step region 22, which facilitates the formation of the antenna apparatus by splicing the antenna units 100 and improves the gain of the antenna units 100.

It can be understood that when the orthographic projection the phase shifting region 20*a* of the antenna unit 100 on the plane where the first substrate 10 is located is in a shape of a square, the first step region 12 and the second step region 22 may also be disposed on a same edge of the phase shifting region 20*a*, as long as the connection requirements between the driver circuit 40, the radio frequency signal end 50 and the phase shifting unit 30 of each antenna unit 100 can be satisfied, and the gain requirement of the formed antenna apparatus can be improved.

Figure 12:
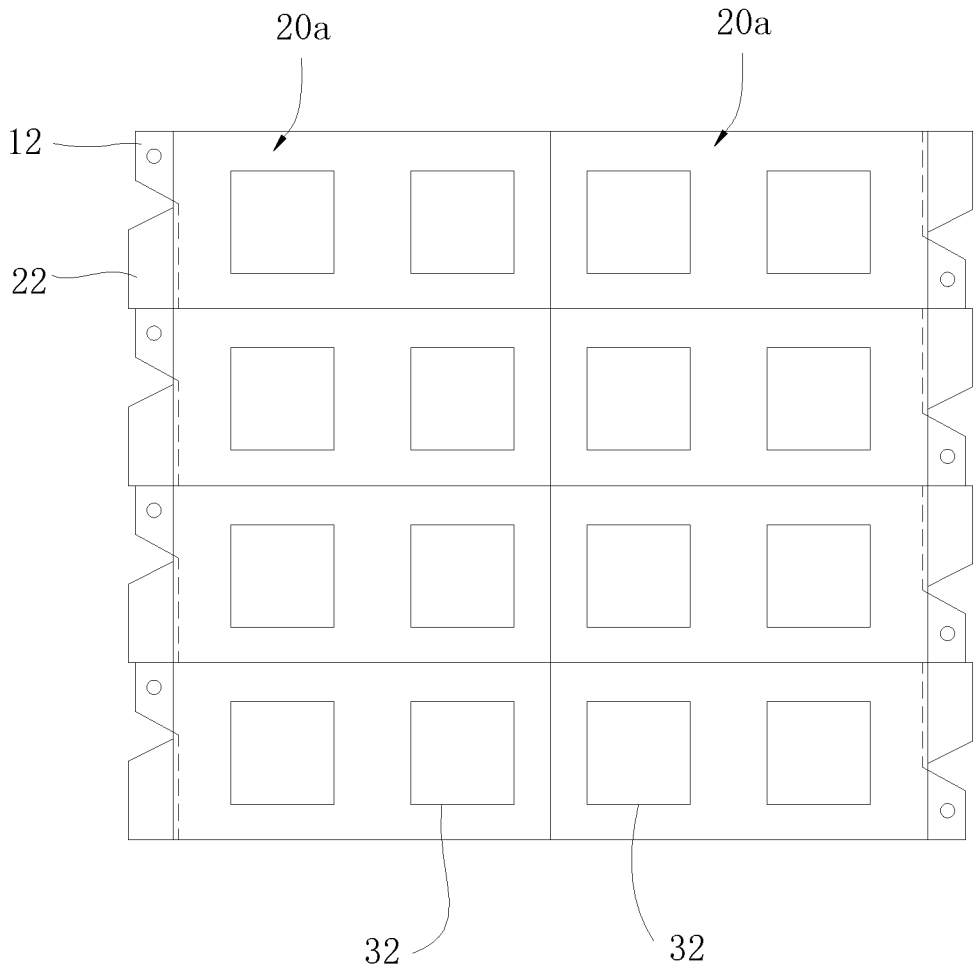
FIG. 12 is a structural diagram of another antenna apparatus according to an embodiment of the present disclosure.

As shown in FIG. 12, it can be understood that when the antenna units 100 included in the antenna apparatus are distributed in rows and columns, the number of the antenna units 100 is not limited to four and may be an even greater than four. In this case, the shape of the orthographic projection of the phase shifting region 20*a* of the antenna unit 100 on the plane where the first substrate 10 is located is not limited to a square, but may also be a rectangle. The direction of which the first step region 12 protrudes from the phase shifting region 20*a* and the direction of which the second step region 12 protrudes from the phase shifting region 20*a* may be the same, for example, the antenna units 100 shown in FIG. 8 may be spliced together. Each row may be made to include two antenna units 100, and the number of antenna units 100 included in each column is set according to gain requirements of the antenna units 100. In an orthographic projection of each antenna unit 100 on the plane where the first substrate 10 is located, the direction of which the first step region 12 protrudes from the phase shifting region 20*a* and the direction of which the second step region 12 protrudes from the phase shifting region 20*a* are the same, first step regions 12 of two antenna units 100 in a same row are arranged away from each other and are disposed asymmetrically, and second step regions 22 of the two antenna units 100 in a same row are arranged away from each other and are disposed asymmetrically. With the above arrangement, the performance requirements of the antenna apparatus can also be satisfied, and the gain of the antenna apparatus can be improved.

It can be understood that when the antenna apparatus provided in the embodiment of the present disclosure includes m antenna units 100, the m antenna units 100 are not limited to the distribution in rows and columns. In some embodiments, m antenna units 100 may be provided, m≥2, and phase shifting regions 20*a* of each of the m antenna units 100 are successively arranged in a ring direction around a same axis and sequentially spliced.

As an embodiment, in the antenna apparatus provided in the embodiment of the present disclosure, after one antenna unit 100 of two adjacent antenna units 100 rotates 360°/m with the axis as a rotation center, and the one antenna unit 100 of the two adjacent antenna units 100 is coincident with the other antenna unit 100 of the two adjacent antenna units 100. Taking there are 3 antenna units 100 as an example, for example, when the orthographic projection of the phase shifting region 20*a* of the antenna unit 100 on the plane where the first substrate 10 is located is in a shape of a rhombus, one antenna unit 100 of the two adjacent antenna units 100 can rotate 120° with the axis as the rotation center and is coincident with the other antenna unit 100 of the two adjacent antenna units 100. This arrangement facilitates the splicing of the antenna units 100, and at the same time, structures of the antenna units 100 constituting the antenna apparatus can be uniformly arranged to facilitate standardization of the antenna units 100.

As an embodiment, in a direction perpendicular to a plane where a first substrate 10 is located, an orthographic projection of a phase shifting region 20*a* of each antenna unit 100 of the m antenna units is in a shape of a polygon and each edge of the polygon is equal in length. With the above arrangement, the orthographic projection of the phase shifting region 20*a* of each antenna unit 100 forming the antenna apparatus in the direction perpendicular to the plane where the first substrate 10 is located can be in a shape of a regular polygon or a rhombus. Splicing between the antenna units 100 is facilitated, performance of the antenna apparatus is optimized, and gain requirement of the antenna apparatus is ensured.

Figure 13:
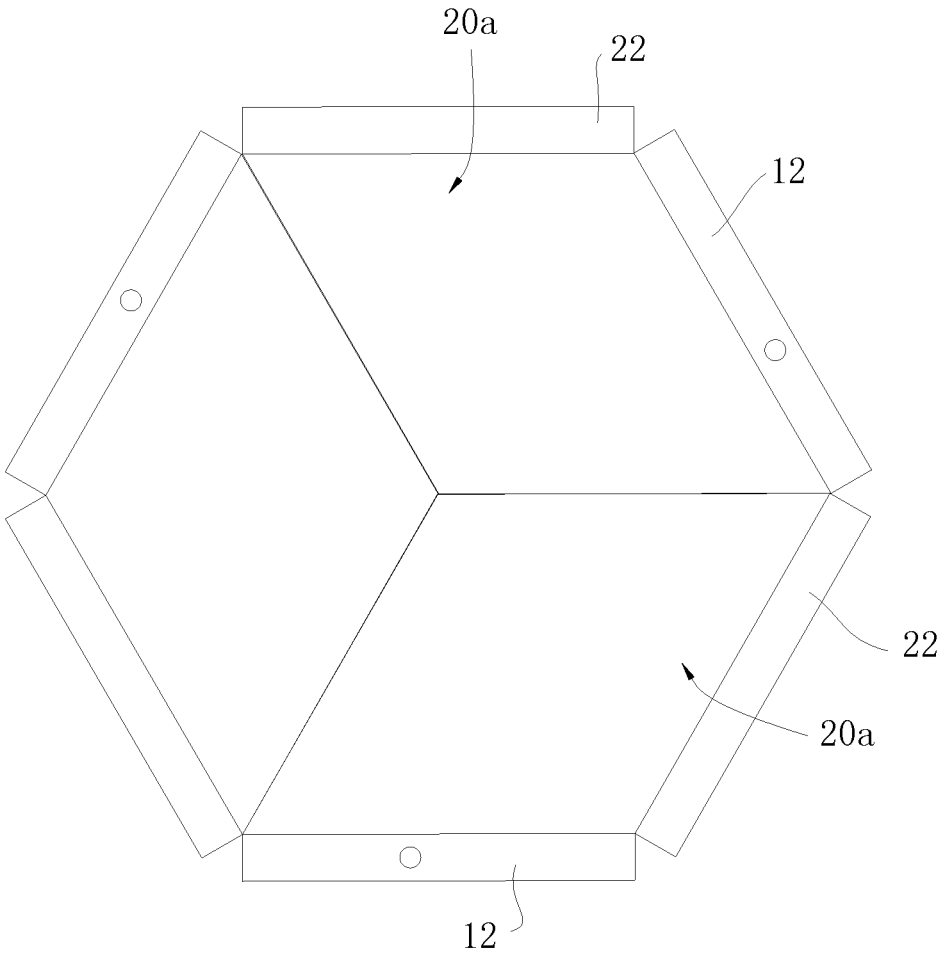
FIG. 13 is a structural diagram of an antenna apparatus according to another embodiment of the present disclosure.

As shown in FIG. 13, exemplarily, in order to better understand the antenna apparatus provided in the embodiment of the disclosure, the antenna apparatus provided by the embodiment of the present disclosure is described by taking the number of antenna units 100 as three as an example. The antenna units 100 included in the antenna apparatus provided in the embodiment of the present disclosure may be antenna units 100 shown in FIG. 6. Intersections of the third edges cc and the fourth edges dd not provided with the first step regions 12 and the second step regions 22 of the phase shifting regions 20*a* of the three antenna units 100 intersect with each other. In two antenna units 100 spliced to each other, a region corresponding to a third edge cc of the phase shifting region 20*a* of one antenna unit 100 of the two antenna units 100 and a region corresponding to the fourth edge dd of the phase shifting region 20*a* of the other antenna unit 100 of the two antenna units 100 are spliced to each other. When the antenna units 100 are spliced, the phase shifting region 20*a* of each of the antenna units 100 are sequentially spliced to form an entire splicing surface, and each first step region 12 and each second step region 22 are alternately disposed on a periphery the entire splicing surface formed by splicing the phase shifting regions 20*a*, that is, in the orthographic projection of the antenna apparatus on the plane where the first substrate 10 is located, the first step region 12 of one of two adjacent antenna units 100 each is separated from the first step region 12 of the other one of two adjacent antenna units 100 by a second step region 22, which facilitates the formation of the antenna apparatus by splicing the antenna units 100 and improves the gain of the antenna units 100.

Figure 14:
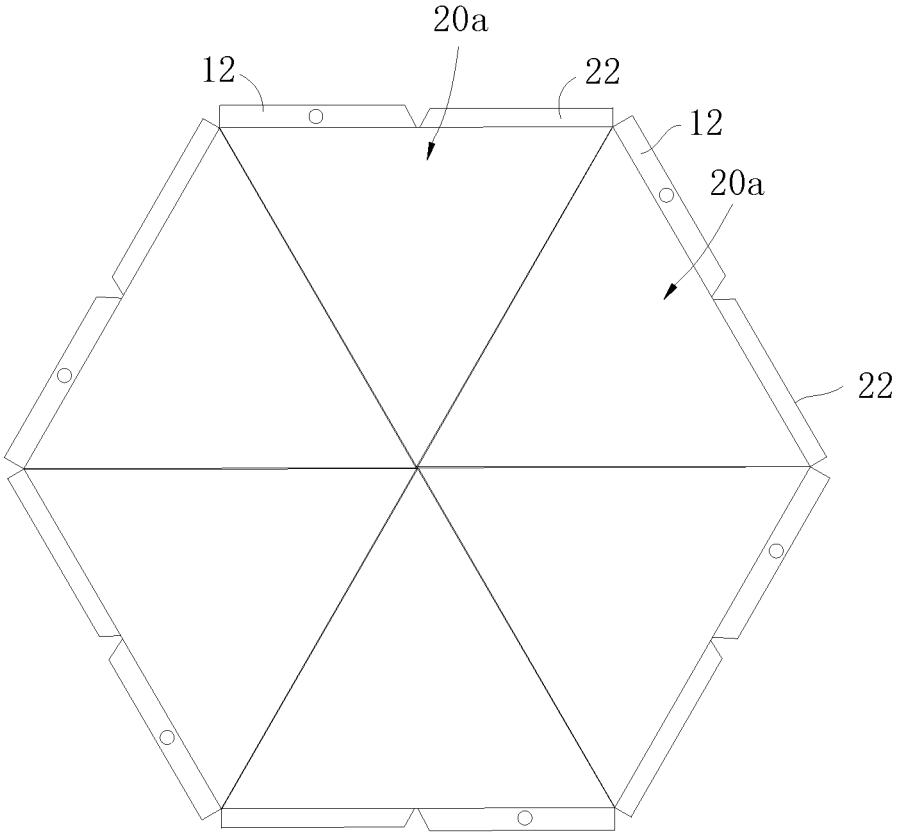
FIG. 14 is a structural diagram of an antenna apparatus according to another embodiment of the present disclosure.

As shown in FIG. 14, for example, the antenna apparatus provided by the embodiment of the present disclosure is described by taking six antenna units 100 provided as an example. The antenna units 100 included in the antenna apparatus provided in the embodiment of the present disclosure may be antenna units 100 shown in FIG. 10. The orthographic projection of the phase shifting region 20*a* of each antenna unit 100 on the plane where the first substrate 10 is located is in a shape of a triangle, and the first step region 12 and the second step region 22 protrude along the same edge of the phase shifting region 20*a*. Intersections of edges not provided with the first step regions 12 and the second step regions 22 of the phase shifting regions 20*a* of the six antenna units 100 intersect with each other. In two antenna units 100 spliced to each other, the second edge bb of the phase shifting region 20*a* of one antenna unit 100 of the two antenna units 100 corresponds to the third edge cc of the phase shifting region 20*a* of the other antenna unit 100 of the two antenna units 100, and a region corresponding to the second edge bb and a region corresponding to the third edge cc are spliced to each other. The phase shifting regions 20*a* of each of the antenna units 100 are sequentially spliced to form an entire splicing surface in a case of splicing, which ensures that each antenna unit 100 of the antenna apparatus has no butting requirement and improves the gain of the antenna unit 100.

Figure 15:
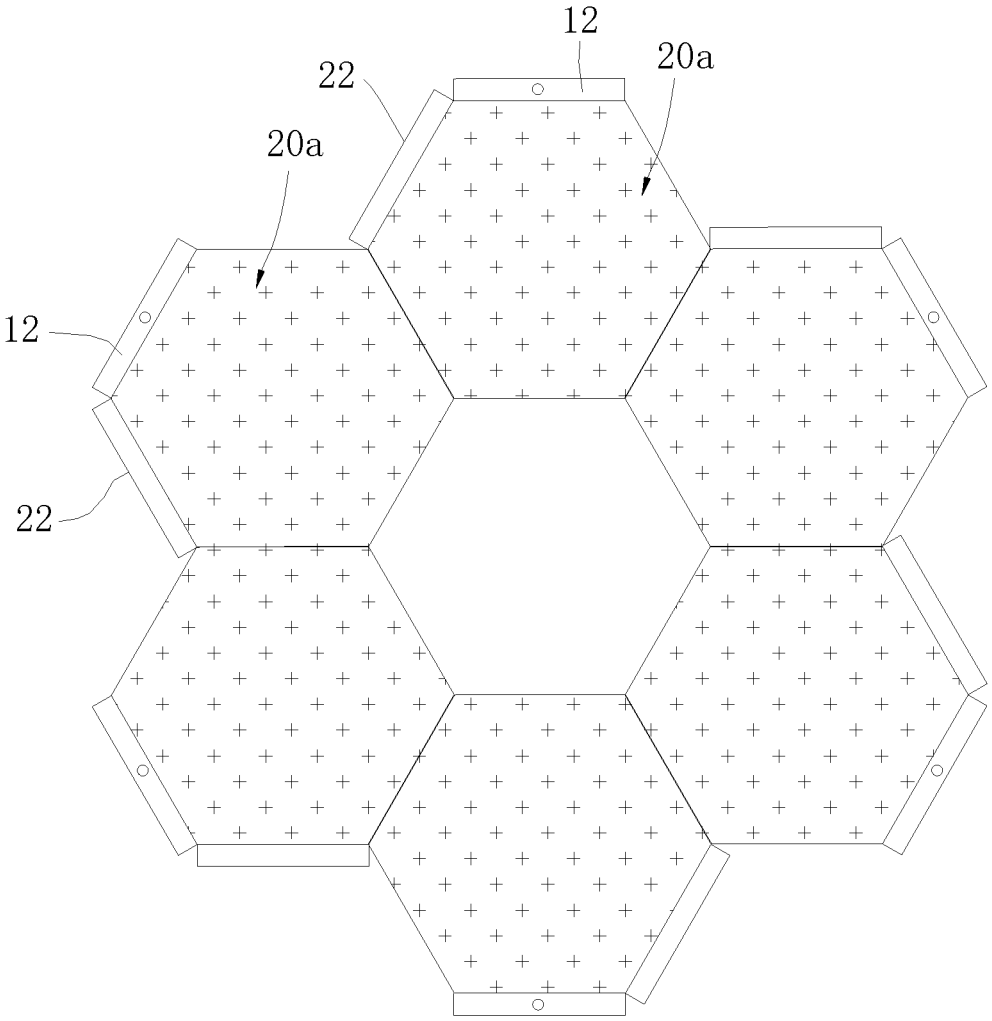
FIG. 15 is a structural diagram of an antenna apparatus according to another embodiment of the present disclosure.

As shown in FIG. 15, for example, the antenna apparatus provided by the embodiment of the present disclosure is described by taking the number of antenna units 100 as six as an example. The antenna units 100 included in the antenna apparatus provided in the embodiment of the present disclosure may be antenna units 100 shown in FIG. 7. The orthographic projection of the phase shifting region 20*a* of each antenna unit 100 on the plane where the first substrate 10 is located is in a shape of a hexagon, and the first step region 12 and the second step region 22 protrude along the same edge of the phase shifting region 20*a*. Intersections of edges not provided with the first step regions 12 and the second step regions 22 of the phase shifting regions 20*a* of the six antenna units 100 intersect with each other. In two antenna units 100 spliced to each other, one of the third edge cc, the fourth edge dd, the fifth edge ee and the sixth edge of the phase shifting region 20*a* of one antenna unit 100 of the two antenna units 100 corresponds to a corresponding edge of the phase shifting region 20*a* of the other antenna unit 100 of the two antenna units 100, and a region corresponding to one of the third edge cc, the fourth edge dd, the fifth edge ee and the sixth edge and a region corresponding to the corresponding edge cc are spliced to each other, which ensures the butting requirement of each antenna unit 100 of the antenna apparatus and improves the gain of the antenna unit 100.

In some embodiments, the antenna apparatus provided in the above embodiments of the present disclosure all are illustrated by taking the same external dimensions of the included antenna elements 100 as an example. This is an embodiment, but limitations would not made thereto. In some embodiments, the antenna units 100 included in the antenna apparatus may include a first antenna unit and a second antenna unit. The first antenna unit 100 has an orthographic projection in a direction perpendicular to a plane where a first substrate 10 of the first antenna unit 100 is located, the second antenna unit 100 has an orthographic projection in a direction perpendicular to a plane where a first substrate 10 of the second antenna unit 100 is located, an area of the orthographic projection of the first antenna unit 100 is greater than an area of the orthographic projection of the second antenna unit 100, and a second antenna units 100 are spliced with a the first antenna units 100. It is also possible to satisfy the splicing requirements of the antenna units 100 of the antenna apparatus while ensuring the gain requirement of the antenna apparatus.

As an embodiment, the antenna apparatus provided in the embodiments of the present disclosure further includes an auxiliary mounting frame, where the antenna units 100 are connected to the auxiliary mounting frame through the second substrates 20 of the antenna units 100. It is possible to facilitate the fixing of the antenna units 100 and ensure the splicing requirement of the antenna units 100 by setting the auxiliary mounting frame.

In yet another embodiment, based on the same inventive concept, the embodiments of the present application further provide an electronic device including the antenna apparatus of any one of the embodiments of the present application. This embodiment merely takes a mobile phone as an example to explain the electronic device. It can be understood that the electronic device provided in the embodiment of the present application can be a wearable product, a computer, a vehicle-mounted electronic device, etc., which are not specifically limited in this application. The electronic device provided in the embodiment of the present application has the beneficial effect of the antenna provided in the embodiment of the present application. For details, reference can be made to the specific description of the antenna in the above embodiments, and this embodiment will not be repeated here.

What is claimed is:

1. An antenna unit, comprising:

a first substrate and a second substrate disposed opposite to each other, wherein a region facing the first substrate and a region facing the second substrate together form a phase shifting region; in a first direction, the first substrate is formed with a first step region protruding from the phase shifting region, and the first step region is used for connecting a radio-frequency signal terminal; and in a second direction, the second substrate is formed with a second step region protruding from the phase shifting region, and an included angle between the first direction and the second direction is greater than or equal to 0° and smaller than 180°; wherein in a direction perpendicular to a plane where the first substrate is located, at least part of the first step region does not overlap at least part of the second step region;

a plurality of phase shifting units, wherein the plurality of phase shifting units are distributed in an array and are located in the phase shifting region, and each phase shifting unit is used for radiating a radio-frequency signal; and a driver circuit, wherein at least part of the driver circuit is disposed in the second step region and the driver circuit is electrically connected to each phase shifting unit to adjust the radio-frequency signal radiated by each phase shifting unit.

2. The antenna unit of claim 1, wherein an orthographic projection of the phase shifting region on the plane where the first substrate is located is in a shape of a polygon, an orthographic projection of the first step region on the plane where the first substrate is located starts from one edge of the polygon and protrudes along the first direction and away from the polygon, and an orthographic projection of the second step region on the plane where the first substrate is located starts from another edge of the polygon and protrudes along the second direction and away from the polygon.

3. The antenna unit of claim 2, wherein each edge of the polygon presented by the orthographic projection of the phase shifting region on the plane where the first substrate is located is equal in length;

wherein the orthographic projection of the phase shifting region on the plane where the first substrate is located is in a shape of a regular polygon, the regular polygon comprises n edges, and n is greater than or equal to 3; or the orthographic projection of the phase shifting region on the plane where the first substrate is located is in a shape of a rhombus.

4. The antenna unit of claim 3, wherein the included angle between the first direction and the second direction is one of 90° and 120°.

5. The antenna unit of claim 1, wherein an orthographic projection of the phase shifting region on the plane where the first substrate is located is in a shape of a polygon, an orthographic projection of the first step region on the plane where the first substrate is located and an orthographic projection of the second step region on the plane where the first substrate is located starts from a same edge of the polygon and protrude away from the polygon.

6. The antenna unit of claim 2, comprising at least one of:

at least one end of the first step region along an extending direction of the edge where the first step region is located is provided with an oblique angle; and at least one end of the second step region along an extending direction of the edge where the second step region is located is provided with an oblique angle.

7. The antenna unit of claim 1, wherein each of the first substrate and the second substrate is a rigid plate; or each of the first substrate and the second substrate is a flexible plate.

8. An antenna apparatus, comprising:

a plurality of antenna units of claim 1, wherein phase shifting regions of the plurality of antenna units are sequentially spliced, and among each two antenna units having a spliced relationship, a phase shifting region of one antenna unit comprises a first side edge facing away from a first step region and a second step region of the one antenna unit, a phase shifting region of the other antenna unit comprises a second side edge facing away from a first step region and a second step region of the other antenna unit, and the first side edge and the second side edge are butted with each other.

9. The antenna apparatus of claim 8, comprising m antenna units, m≥2; and phase shifting regions of the m antenna units are successively arranged in a ring direction around a same axis and sequentially spliced.

10. The antenna apparatus of claim 9, wherein after one antenna unit of two adjacent antenna units of the m antenna units rotates 360°/m with the axis as a rotation center, the one antenna unit of two adjacent antenna units is coincident with the other antenna unit of the two adjacent antenna units;

wherein in the direction perpendicular to the plane where the first substrate is located, an orthographic projection of a phase shifting region of each antenna unit of the m antenna units is in a shape of a polygon, and each edge of the polygon is equal in length.

11. The antenna apparatus of claim 8, comprising m antenna units, m≥2; and the m antenna units are distributed in rows and columns, and each row comprises two antenna units;

wherein an orthographic projection of each phase shifting region on a plane where the first substrate is located is in a shape of a quadrangle.

12. The antenna apparatus of claim 11, comprising four antenna units, wherein the four antenna units are distributed in rows and columns, each row comprises two antenna units of the four antenna units, and each column comprises two antenna units of the four antenna units;

wherein in an orthographic projection of the antenna apparatus on the plane where the first substrate is located, among two adjacent antenna units of the four antenna units, a first step region of one antenna unit is separated from a first step region of the other adjacent antenna unit by a second step region; and wherein in an orthographic projection of each antenna unit of the four antenna units on the plane where the first substrate is located, a direction of a first step region protruding from a phase shifting region of each antenna unit is same as a direction of a second step region protruding from the phase shifting region of each antenna unit, or a direction of a first step region protruding from a phase shifting region of each antenna unit intersects a direction of a second step region protruding from the phase shifting region of each antenna unit.

13. The antenna apparatus of claim 11, wherein in an orthographic projection of each antenna unit of the m antenna units on the plane where the first substrate is located, a direction of a first step region protruding from a phase shifting region of each antenna unit is same as a direction of a second step region protruding from the phase shifting region of each antenna unit, first step regions of two antenna units in a same row are arranged away from each other and are disposed asymmetrically, and second step regions of the two antenna units in a same row are arranged away from each other and are disposed asymmetrically.

14. The antenna apparatus of claim 8, wherein the plurality of antenna units comprise a first antenna unit and a second antenna unit; and the first antenna unit has an orthographic projection in a direction perpendicular to a plane where a first substrate of the first antenna unit is located, the second antenna unit has an orthographic projection in a direction perpendicular to a plane where a first substrate of the second antenna unit is located, an area of the orthographic projection of the first antenna unit is greater than an area of the orthographic projection of the second antenna unit, and a plurality of the second antenna units are spliced with a plurality of the first antenna units.

15. The antenna apparatus of claim 8, wherein a phase shifting unit of each antenna unit comprises a power feeder, a radiator, a grounding electrode, a drive electrode and a dielectric layer, wherein the power feeder is electrically connected to a radio-frequency signal terminal, and the radiator is coupled with the power feeder; and in a direction perpendicular to a plane where the first substrate is located, the drive electrode overlaps the power feeder and the grounding electrode, and the dielectric layer is disposed between the drive electrode and the grounding electrode.

16. The antenna apparatus of claim 15, wherein a minimum distance A is provided between two adjacent radiators of each antenna unit, and among two antenna units spliced with each other, a minimum distance B is provided between a radiator of one antenna unit and a radiator of the other antenna unit disposed adjacent to the radiator of the one antenna unit, and wherein A=B.

17. The antenna apparatus of claim 15, wherein in each antenna unit, the grounding electrode is disposed in a layer different from a layer where the drive electrode and the power feeder is disposed, the power feeder and the radiator are disposed on a surface of the first substrate facing away from the second substrate, the grounding electrode is disposed on a surface of the first substrate facing the second substrate, and the drive electrode is disposed on a surface of the second substrate facing the first substrate; or, wherein the grounding electrode and the power feeder are disposed in a same layer, the radiator, the power feeder and the grounding electrode are all disposed on a surface of the first substrate facing the second substrate, and the drive electrode is disposed on a surface of the second substrate facing the first substrate.

18. The antenna apparatus of claim 15, further comprising a power feeder line, wherein the first substrate of each antenna unit is provided with the power feeder line, and power feeders of a plurality of phase shifting units of a same antenna unit are electrically connected to a same radio-frequency signal terminal through the power feeder line;

wherein each antenna unit further comprises a plurality of control signal lines, wherein the plurality of control signal lines are disposed on the second substrate, and a drive electrode of each phase shifting unit of a same antenna unit is connected to the driver circuit of the same antenna unit through one control signal line of the plurality of control signal lines; and wherein a driver circuit of each antenna unit comprises a flexible circuit board, the flexible circuit board comprises a plurality of control signal terminals, and the plurality of control signal terminals are electrically connected to the plurality of control signal lines in one-to-one correspondence.

19. The antenna apparatus of claim 8, further comprising an auxiliary mounting frame, wherein the plurality of antenna units are connected to the auxiliary mounting frame through the second substrates of the plurality of antenna units.

20. An electronic device, comprising the antenna apparatus of claim 8.

* * * * *